US005603144A

United States Patent [19]

Akashi

[11] Patent Number: 5,603,144

[45] Date of Patent: Feb. 18, 1997

[54] AUTOMATIC LOCK SLIDER FOR SLIDE FASTENER

[75] Inventor: Shunji Akashi, Toyama-ken, Japan

[73] Assignee: YKK Corporation, Tolyo, Japan

[21] Appl. No.: 413,950

[22] Filed: Mar. 30, 1995

[30] Foreign Application Priority Data

Apr. 5, 1994 [JP] Japan ..... 6-066999

[51] Int. Cl.[6] ..... A44B 19/30

[52] U.S. Cl. ..... 24/421; 24/423; 24/424

[58] Field of Search ..... 24/423, 420, 421, 24/424

[56] References Cited

U.S. PATENT DOCUMENTS

| | | | |
|---|---|---|---|
| 2,178,948 | 11/1939 | Brozek | 24/423 |
| 3,798,715 | 3/1974 | Moertel | 24/423 |
| 3,977,052 | 8/1976 | Takamatsu | 24/423 |
| 4,667,376 | 5/1987 | Ishii et al. | 24/421 |

FOREIGN PATENT DOCUMENTS

| | | | |
|---|---|---|---|
| 220073 | 10/1958 | Australia | 24/421 |
| 686418 | 5/1964 | Canada | 24/421 |
| 727851 | 2/1966 | Canada | 24/421 |
| 62-41608 | 10/1987 | Japan . | |
| 7413917 | 5/1975 | Netherlands | 24/421 |

*Primary Examiner*—Peter M. Cuomo
*Assistant Examiner*—Hanh V. Tran
*Attorney, Agent, or Firm*—Hill, Steadman & Simpson

[57] ABSTRACT

In an automatic lock slider for a slide fastener having element rows on its back side, a resilient member having a locking pawl engageable and disengageable with the element rows from the back side is actuated by one end of a pivotal bat pivotable about a pivot, the resilient member being in the form of a small-width metallic leaf spring having a predetermined length and bent in a desired shape. The resilient member keeps adequate resilience for a long period and secures more reliable resilient deformation and restoration compared to a mere leaf spring, so that the locking pawl can come into and out of engagement with the element rows smoothly and reliably, depending on whether or not a pull tab is pulled. Not only in a concealed slide fastener but also in an ordinary slide fastener, partly since an upper wing is merely flat, and partly since the width of the upper wing is reduced as small as possible, it is possible to reduce the part of the slider exposed on the front surface of the slide fastener to a minimum amount.

9 Claims, 6 Drawing Sheets

AUTOMATIC LOCK SLIDER FOR SLIDE FASTENER

BACKGROUND OF THE INVENTION

1. Field of the Invention

This invention relates to a slide fastener slider in which a slider lock mechanism equipped in the slider automatically become operative to prevent the slider from further movement along element rows when a pull tab is released from fingers, and more particularly to an automatic lock slider suitable for both an ordinary slide fastener and a concealed slide fastener.

2. Description of the Related Art

Some of conventional slide fasteners of the ordinary type in which coupling element rows are exposed on the tape surfaces are equipped with a slider locking mechanism for keeping the slider from sliding unless a pull tab is pulled. In the most popular type of the conventional slider locking mechanisms, a locking pin projecting perpendicularly from a pintle of the pull tab comes into engagement with the element rows to prevent further movement of the slider when the pull tab is released from a pulling force to fall flat on the upper wing of the slider body.

In another conventional slider locking mechanism, as disclosed in, for example, Japanese Utility Model Publication No. SHO 62-41608, when the pull tab is pulled, a locking pawl formed on one end of a leaf spring whose other end is secured to the slider body is raised to be disengaged from the element rows, and when no pulling force is exerted on the pull tab, the locking pawl comes into engagement with the element rows through an aperture of the slider body under the resilience of the leaf spring to automatically prevent further movement of the slider.

However, if the foregoing conventional slider locking mechanism is applied to the concealed slide fastener in which the element rows are not exposed on the tape surfaces, the locking pin tends to pierce into the confronting inner edges of the opposed tapes concealing the opposed element rows from the outer side, so that the reliable locking function cannot be achieved on many occasions. Consequently, in the concealed slide fastener, it is customary to employ the above-mentioned slider locking mechanism so as to act on the back surfaces of the tapes where the coupling element rows come out.

This prior art is exemplified by U.S. Pat. Nos. 2,178,948 and 2,178,949. The automatic lock mechanism of the slider disclosed in these U.S. Patents is suitable for a kind of concealed slide fastener in which cloth or rubber tapes cover the majority of whole leg portions of the opposed element rows, with head portions exposed in the front tape surfaces. In this prior art lock mechanism, a pair of locking pawls projecting substantially perpendicularly from a right and left edges of a leaf spring, which is fixed at one end to the back surface of the slider body, and having a width substantially equal to the width of the back surface of the slider body, is brought into and out of engagement with the leg portions of adjacent elements of the individual element rows of opposed fastener stringers in the slider body, in response to pivotal or sliding movement of a pull tab when pulled.

Japanese Utility Model Publication No. SHO 54-31048 discloses an automatic lock slider for concealed slide fasteners. In the automatic lock slider, a pivotal bar connected to a pull tab has at its lower portion a pair of longitudinally confronting shoulders, and a leaf spring having at one end a locking pawl is fixed at the other end to the back surface of the slider body. As the pivotal bar is urged from its back side by the leaf spring, the shoulders are brought into engagement with the lower end of a through hole extending vertically in an element guide post of the slider body. Further, the through hole has a predetermined size such that the pivotal bar can be pivotally moved in the through hole. While the slider is not pulled, the locking pawls are brought into engagement with the element rows in the slider body to keep the slider from moving along the element rows. When the slider is pulled, the pivotal bar is pivotally moved in the through hole longitudinally of the slider body to deform the leaf spring against its resilience by the shoulders, thus releasing the locking pawls from the element rows. A concealed slide fastener has a stringer structure that is most popular in recent years. In the stringer structure, the element-row-attaching edge of each tape is bent in a U shape, and the individual element row is attached to the corresponding tape along the bent edge by sewing or other means. When the tapes of the concealed slide fastener are attached to a product, the element rows are located on the back side of the product.

With the automatic lock slider, for ordinary slide fasteners, disclosed in Japanese Utility Model Publication No. SHO 62-4160B, since the pintle of the pull tab and the leaf spring mounted on the slider body is concealed completely from outside by a covering, part of the slider projecting from the front surfaces of the opposed fastener stringers is necessarily larvae and hence tends to contact other things around and would have an unsightly appearance. Consequently, even in the ordinary slide fastener equipped with the automatic lock mechanism, it is strongly required to minimize part of the slider exposed from the front surfaces of opposed fastener stringers.

According to the automatic lock mechanism, for concealed slide fasteners, disclosed in the above-mentioned U.S. Patents, since the leaf spring is resiliently deformed via an actuating member in combination of the action of the pull tab and an associated cam mechanism, not only adequate precision is required in machining and assembling, but also reliable engagement and disengagement of the locking pawls with the elements cannot be guaranteed because the leaf spring is hard to deform due to its large width, depending on the movement of the pull tab. On the other hand, according to the automatic lock mechanism disclosed in Japanese Utility Model Publication No. SHO 54-31048, although it is simple in structure and hence is not so high machining precision, there is no guarantee that the pivotal bar is pivotally moved reliably, thus often causing unsmooth coupling and uncoupling of the locking pawl with the elements.

SUMMARY OF THE INVENTION

It is therefore an object of this invention to provide an automatic lock slider which is suitable for concealed slide fasteners and ordinary slide fasteners as well, partly since the slider has a simple structure and secures reliable coupling and uncoupling of a locking pawl with elements rows, and partly since a slider body part projecting from the front surfaces of opposed fastener stringers is minimized.

According to this invention, there is provided an automatic lock slider for a slide fastener, comprising a slider body having an element guide channel for slidably guiding opposed element rows and an element guide post situated centrally at one end of the element guide channel, a pull tab rotatably attached to the slider body, and a pivotal bar being inserted in a through hole formed vertically through the element guide post for actuating a locking pawl of a resilient member which is disposed in a lower portion of the slider body to perform an automatic lock mechanism. The slider is characterized in that the pivotal bar has a generally L shape composed of an insertion portion inserted in the through hole an attachment portion to be normally located against an upper surface of the slider body, and a connection portion connecting the insertion portion, and the attachment portion is pivoted on an upper portion of the element guide post, and that the through hole receives the insertion portion of the pivotal bar with a gap which allows the insertion portion to be pivotally movable forwardly and backwardly. The slider is also characterized in that the resilient member is in the form of a small-width metallic leaf spring bent in a predetermined shape, has the locking pawl to be inserted in an aperture provided in a lower surface of the element guide channel, and is attached in the bottom of the slider body.

Preferably, the resilient member is bent in a generally U shape, and the other end opposite to the locking pawl of the resilient member is fixedly attached to the bottom of slider body. Alternatively, the resilient member is bent in a generally L shape and has at the other end opposite to the locking pawl an rising portion fixedly attached to the element guide post. Further, the resilient member has a contact surface upwardly sloping toward the locking pawl, and a lower end of the insertion portion of the pivotal bar is engageable with the contact surface of the resilient member when the resilient member is actuated by the pivotal bar. And the insertion portion of the pivotal bar has at a lower end a projection directed toward the locking pawl of the resilient member.

The automatic lock slider of this invention is suitable for ordinary slide fasteners. Opposed fastener stringers are threaded through the slide to complete a slide fastener according to the usual method. The resulting slide fastener is attached to a product such as a garment or a bag, with the fastener tape surfaces, in which the entire element rows are exposed, back side. On the front surfaces of the garment and bag, accordingly, only head portions of the element rows slightly come out when the slide fatener is opened, and the whole element rows are covered by the opposed tapes when the slide fastener is closed, giving the same appearance as a concealed slide fastener.

In use, when the slider is pulled to slide along the element rows, the attachment portion of the generally L-shape pivotal bar is raised by the pull tab to pivotally move the pivotal bar about the pivot. This causes the lower end of the insertion portion, which is inserted in the through hole extending vertically in the element guide post of the slider body, to act on a contact slope of the small-width leaf spring bent in a predetermined shape, so that the leaf spring's locking pawl projecting from the aperture of the lower wing of the slider body into the element guide channel to engage the element rows is retracted in the aperture to release the engagement with the element rows. Thus by pulling the pull tab, the lock mechanism of the slider is automatically released so that the slider can slide freely.

When the pull tab is released from hand, the insertion portion of the pivotal bar is returned to the bottom of a V-shape portion of the leaf spring along the contact slope, and at the same time, the locking pawl retracted in the aperture is projected from the aperture into the element guide channel to engage the element rows in the guide channel from the lower side so that the slider is prevented from sliding freely.

With this automatic lock mechanism, since the generally L-shape pivotal bar is pivotally moved about the pivot, the locus of movement of the lower end of the insertion portion of the pivotal bar is definitely determined to secure the reliable action of the pivotal bar on the leaf spring, thus making the engaging and disengaging of the locking pawl with respect to the element rows smooth. Because of this structure, the leaf spring can keep adequate resilience for a long time and can secure more desirable resilient deformation and restoration compared to a mere leaf spring. Another advantageous feature of the slider of this invention is that the slider can be used also to a concealed slide fastener in which the element rows with the ordinary fastener stringers are prevented from coming out. In addition, partly since the inside surface of the upper wing to which the pull tab is attached are flat to merely frictionally guide the surfaces of the tapes, and partly since only the pivot of the pivotal bar projects on the upper wing, it is possible to reduce the width of the leaf spring to a minimum, thus downsizing the slider.

In the foregoing example, the automatic lock slider is applied to the ordinary slide fastener. Alternatively it may be applied to the ordinary concealed slide fastener, demonstrating the same results.

DETAILED DESCRIPTION OF THE PREFERRED EMBODIMENTS

Figure 1:
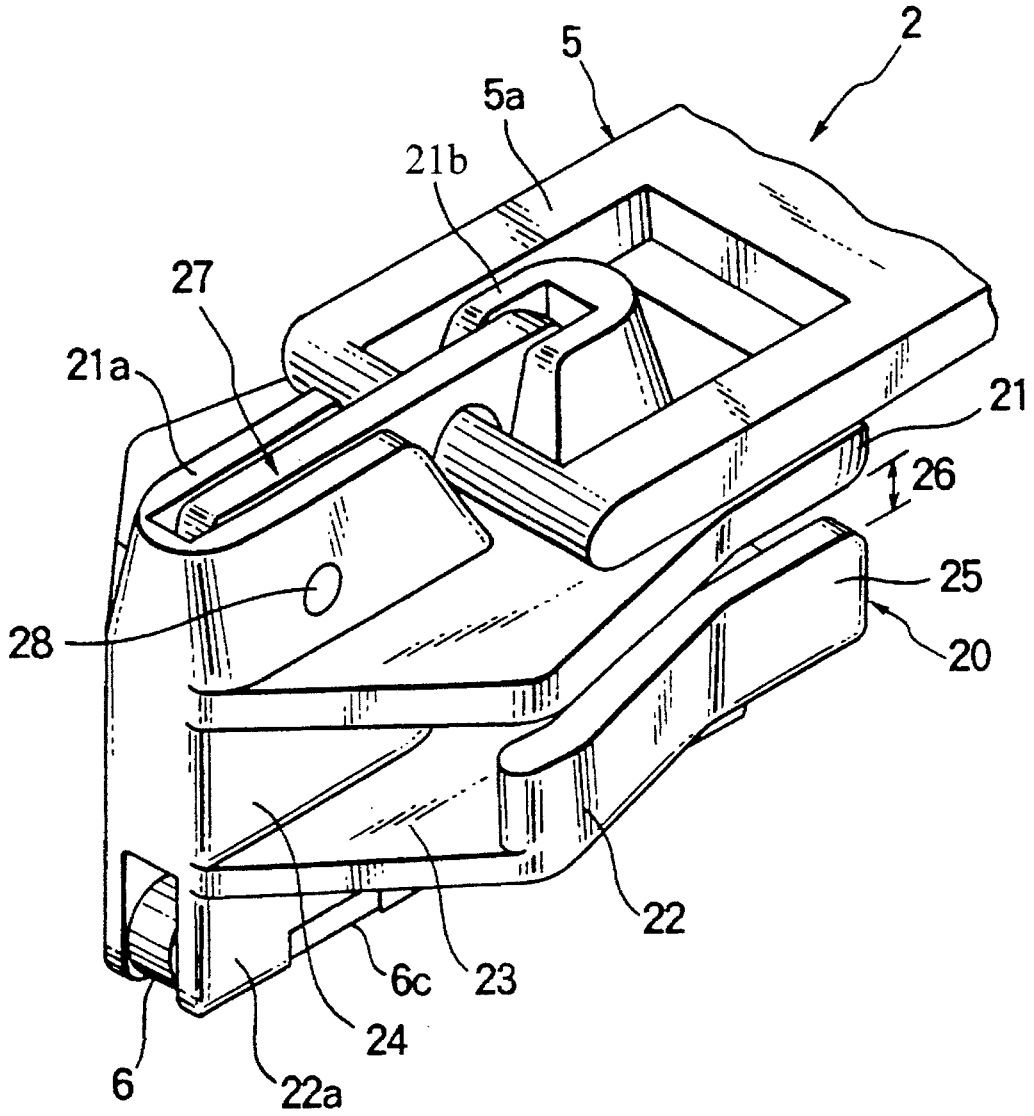
FIG. 1 a perspective view of a typical embodiment of an automatic lock slider, which is to be applied to the ordinary slide fastener, of this invention.
Figure 2:
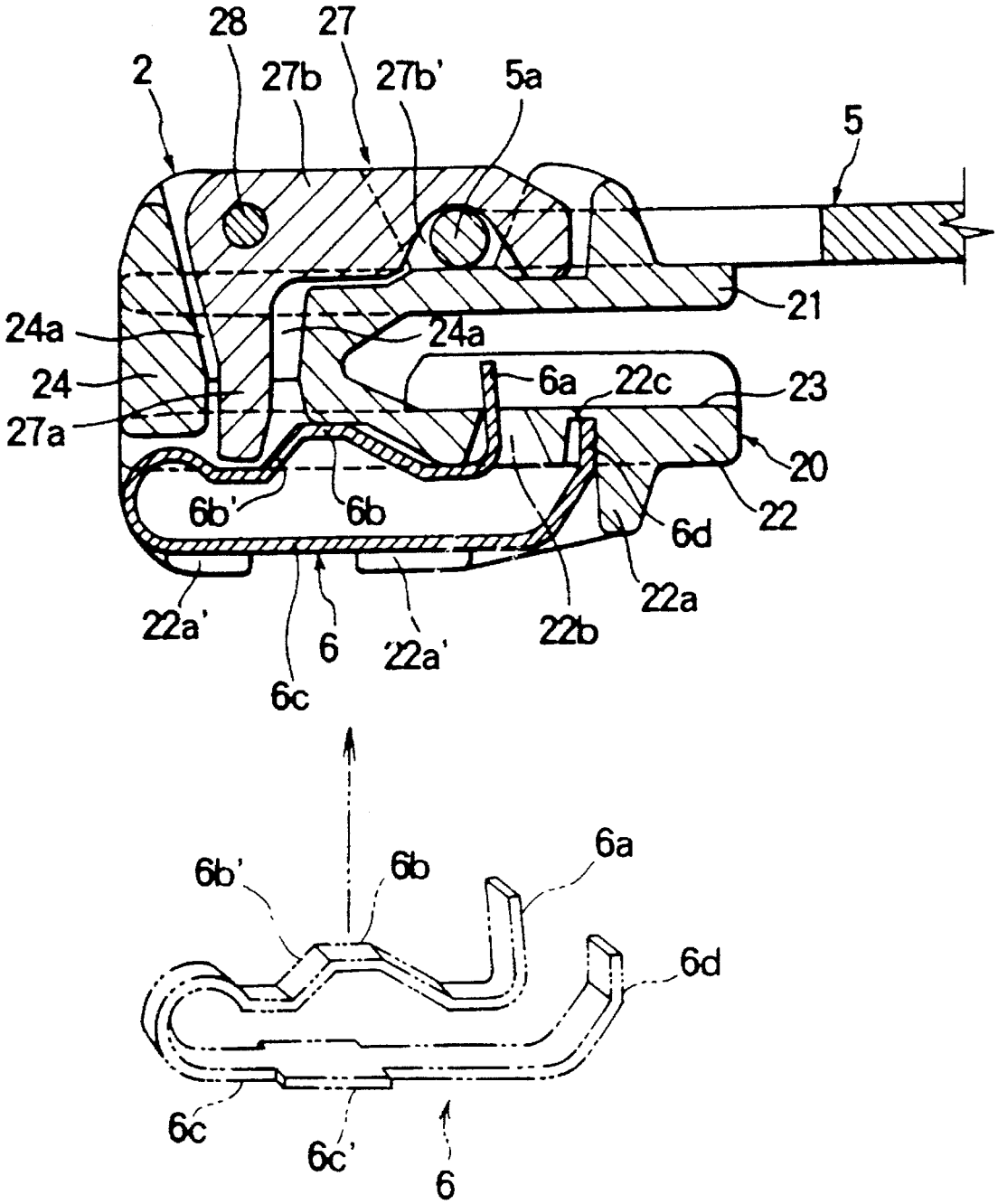
FIG. 2 is a view illustrating the slider of FIG. 1 with parts omitted when a slider lock mechanism assumes an operative position.
Figure 3:
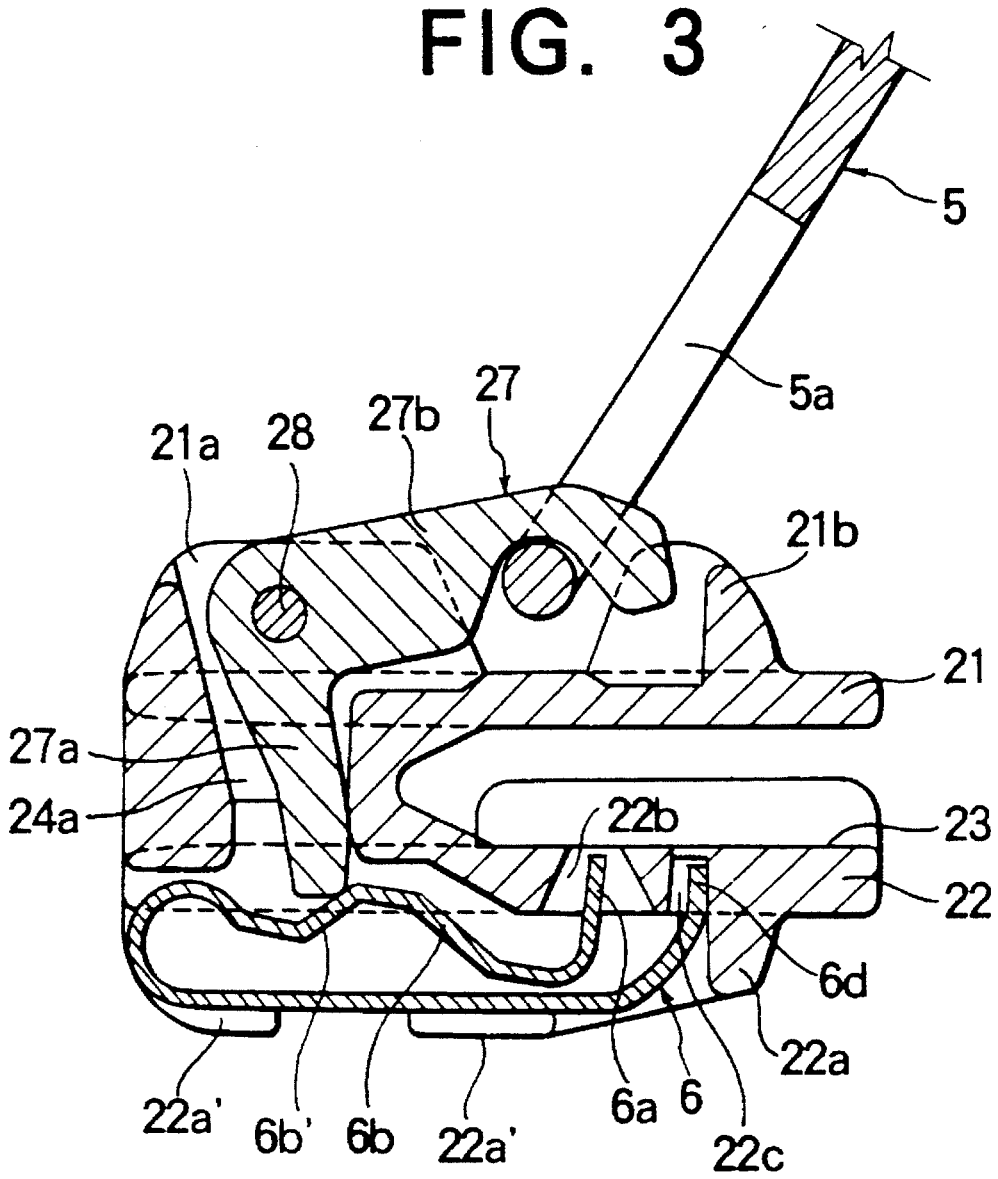
FIG. 3 is a cross-sectional view similar to FIG. 2, showing the slider when the slider lock mechanism assumes an inoperative position.
Figure 6:
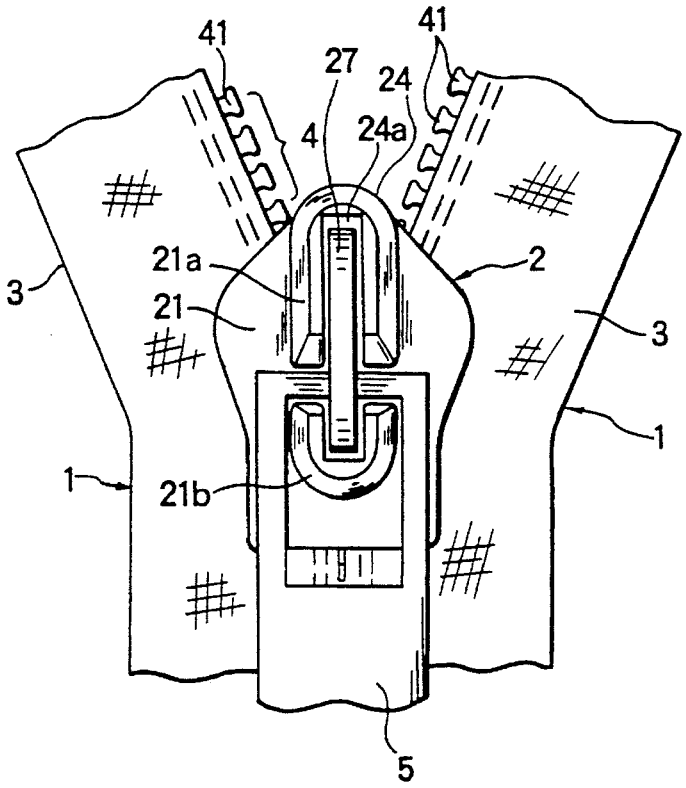
FIG. 6 is a fragmentary plan view of a slide fastener, showing the manner in which the slider of FIG. 1 is mounted on the slide fastener.
Figure 7:
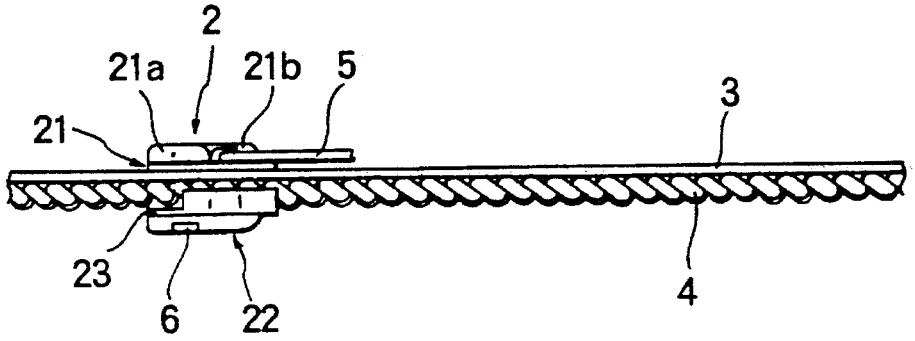
FIG. 7 is a fragmentary side view of the slide fastener of FIG. 6.

Embodiments of this invention will now be described in detail with reference to the accompanying drawings. FIGS. 1 through 3 show an automatic lock slider, which is to be applied to the ordinary slide fastener, according to a first typical embodiment of this invention; FIG. 1 is a perspective view of the slider, FIG. 2 is a longitudinal cross-sectional view showing the slider when a slider lock mechanism assumes an operative position, and FIG. 3 is a longitudinal cross-sectional view showing the slider when the slider lock mechanism assumes an inoperative position. FIGS. 6 and 7 show an example in which the slider is applied to the ordinary slide fastener.

In FIGS. 6 and 7, reference numeral 1 designates opposed fastener stringers, and 2 designates an automatic lock slider of this invention. In the pair of stringers 1 of the illustrated example, a pair of coiled synthetic resin element rows 4 is attached to the back surfaces of ordinary fastener tapes 3 along their confronting edges by sewing leg portions of the elements with the individual head portions 41 of each element row 4 projecting from the corresponding tape edge. The slider 2 has an ordinary structure of FIG. 6 rather than a special structure as the slider for a concealed slide fastener. As shown in FIG. 6, the slider 2 has between upper and lower wings 21, 22 a channel 23 for guiding the opposed element rows 4, and the upper and lower wings 21, 22 are bridged by a guide post 24 at the forward end of the channel 23 for separating and guiding the opposed element rows 4. The upper and lower wings 21, 22 and the guide post 24 constitute a slider body 20. To the upper surface of the upper wing 21, a pull tab 5 is attached so as to be pivotally movable longitudinally of the slider body 20. In this embodiment, the slider 2 is identical with the ordinary slider 2 except that the slider is threaded on the opposed fastener stringers 1 reversely. Namely, the upper wing 21, to which the pull tab 5 is attached, is located on the tape side opposite to the side on which the element rows 4 are exposed, and the lower wing 22 is located on the tape side on which the element rows 4 are exposed. This is because the slider 2 of this invention has a special structure different in part from the conventional slider and is also different in use from the conventional slider.

The detailed structure of the slider 2 will now be described using FIGS. 1 through 3. In FIG. 1, the slider body 20, like the ordinary slider, is composed of the upper and lower wings, 21, 22 and the guide post 24 bridging between the upper and lower wings 21, 22. The upper wing 21 is flat, and the lower wing 22 has along opposite side edges opposed flanges 25 rising toward the upper wing 21. The upper and lower wings 21, 22 jointly define the guide channel 23 for the passage of the element rows 4. The opposite side edges of the upper wing 21 are spaced from the respective upper edges of the opposite flanges 25 of the lower wing 22 by a gap 26 large enough for the passage of the fastener tapes 3. When the element rows 4 is threaded through the guide channel 23 of the slider 2, the opposed fastener tapes 3 are received in the gap 26 and extend outwardly from the slider 2. During that time, the parts of the slider body 20 projecting from the surface of the slide fastener are only the flat upper wing 21 and first and second rising walls 21*a*, 21*b* described below.

A vertical through hole 24*a* extends substantially centrally in the guide post 24. Further, in the illustrated embodiment, the upper wing 21 has on its upper surface the first rising wall 21*a* surrounding the through hole 24*a* in a substantially U shape with its open end remote from the guide post 24. The upper wing 21 also has on its upper surface the generally U-shape second rising wall 21*b* whose open end confronts the open end of the first rising wall 21*a* with a predetermined gap. In the first and second rising walls 21*a*, 21*b*, a pivotal bar 27, which is one of characteristic features of this invention, is mounted.

This pivotal bar 27 is of a generally L shape, as shown in FIG. 2, having an insertion portion 27*a* to be inserted in the through hole 24*a*, and an attachment portion 27*b* extending substantially perpendicularly from the upper end of the insertion portion 27*a* and located on the upper surface of the upper wing 21, the attachment portion 27*b* being received in the first and second rising walls 21*a*, 21*b*. A connecting portion connecting the insertion portion 27*a* and the attachment portion 27*b* is pivoted by a pivot 28 horizontally supported by the first rising wall 21*a* so that the pivotal bar 27 is pivotally movable about the pivot 28 in a plane perpendicular to the general plane of the slide fastener. For this purpose, the insertion hole 24*a* has a longitudinally elongated, generally trapezoidal cross-sectional shape, as shown in FIG. 2. The attachment portion 27*b* has in its lower surface toward the distal end a transversely extending groove 27*b'* for receiving an attachment ring 5*a* of the pull tab 5. The pivotal bar 27 is mounted on the slider body 20 by inserting the insertion portion 27*a* into the through hole 24*a*, placing the attachment portion 27*b* in the first and second rising walls 21*a*, 21*b*, inserting the pivot 28 through non-illustrated holes formed respectively in the first and second rising walls 21*a*, 21*b* and the pivotal bar 27 and then clinching opposite ends of the pivot 28.

In the illustrated embodiment, the lower wing 22, in which the lower end of the insertion hole 24*a* opens, has a generally U-shape transverse cross section, having on the back side a generally U-shape wall 22*a* opening toward the side where the insertion hole 24*a* opens, and a vertically extending, generally frustoconical aperture 22*b* is located substantially centrally in the element guide channel 23. In the back surface of the lower wing 22, an anchor recess 22*c* is formed at a position spaced from the aperture 22*b*. A resilient member 6 constituting part of the characteristic feature of this invention has at one end a locking pawl 6*a* inserted in the aperture 22*b* and at the other end an anchoring portion 6*d* engaged in the anchor recess 22*c*. Further, in the case of the illustrated example, the wall 22*a* has clinching projections 22*a'* extending one from each of confronting edges of the walls 22*a*.

The resilient member 6 is in the form of a small-width metallic leaf spring having a predetermined length. In this embodiment, the metallic leaf spring is bent in a generally U shape having a first section 6*b* bent in a zigzag shape and a second section 6*c*. The distal end of the first section 6*b* is bent perpendicularly away from the second section, 6*c* to form the locking pawl 6*a*. Because of this shape, the resilient member 6 keeps its adequate resilience for a long period and secures more reliable resilient deformation and restoration compared to a mere leaf spring. The distal end of the second section 6*c* is bent remotely from and substantially parallel to the locking pawl 6*a* in the same direction. The first section's zigzag contact surface, with which the insertion portion 27*a* of the pivotal bar 27 is resiliently engageable, has a V-shape portion so that the locking pawl 6*a* is allowed to project into the element guide channel 23 from the aperture 22*b* when the insertion portion 27*a* assumes an inoperative position, and has a contact surface 6*b* upwardly sloping toward the locking pawl 6*a* so that the locking pawl 6*a* is retracted in the aperture 22*b* when the insertion portion 27*a* assumes an operative position.

The resilient member 6 is mounted on the slider body 20 by inserting the locking pawl 6*a* into the aperture 22*b* formed in the lower wing 22 and also inserting and securing the anchoring portion 6*d* in the anchor recess 22*c* next to the aperture 22*b*. Then the clinching projections 22*a'* projecting from the edges of the wall 22*a* are clinched to secure the resilient member 6 to the back surface of the lower wing 22. In the illustrated example, the second section 6*c* of the resilient member 6 has at a portion corresponding to the portion between the adjacent clinching projections 22*a'* a pair of side projections 6*c'* to be fitted between the clinching projections 22*a'*, so that securing by clinching can be reliable.

The opposed fastener stringers 1 are threaded through the thus assembled automatic lock slider 2 as mentioned above and shown in FIGS. 6 and 7, thereby completing the slide fastener according to the usual method. The resulting slide fastener is attached to a garment or a bag with one-side fastener tape surfaces, to which the whole element rows 4 are exposed, back side. As a result, only the head portions 4*a* of the element rows 4 come out to the front surface of a garment or a bag when the slide fastener is opened. When the slide fastener is closed, the whole element rows 4 are covered by the opposed fastener tapes 3, giving the same appearance as a concealed slide fastener.

When the pull tab 5 is gripped by fingers to pull the slider 2 longitudinally along the fastener tapes, the attachment portion 27*b* of the pivotal bar 27 are raised by the pull tab 5, as shown in FIG. 3, to cause the pivotal bar 27 to pivotally move counterclockwise in FIG. 3 about the pivot 28 so that the lower end of the insertion portion 27*a* acts on the contact surface 6*b'* of the first section 6*b* of the resilient member 6. This causes the locking pawl 6*a* of the first section 6*b* of the resilient member 6, which is projected into the element guide channel 23 from the aperture 22*b* to engage the element rows 4, to retract in the aperture 22*b*, disengaging the locking pawl 6*a* from the element rows 4. Accordingly, the lock mechanism of the slider 2 is automatically released to allow the slider 2 to slide freely.

When the pull tab 5 is released from hand, the attachment portion 27*b* of the pivotal bar 27 is returned to the bottom of a V-shape portion along the contact slope surface 6*b'* formed on the first section 6*b* of the resilient member 6 and, at the same time, the locking pawl 6*a* retracted in the aperture 22*b* is projected from the aperture 22*b* into the element guide channel 23 to engage the element rows 4 in the guide channel 23 from the lower side so that the slider lock mechanism works automatically to prevent the slider 2 from sliding freely.

With this automatic lock mechanism, since the generally L-shape pivotal bar 27 is pivotally moved about the pivot 28, the locus of movement of the lower end of the insertion portion 27*a* of the pivotal bar 27 is definitely determined to secure the reliable action of the pivotal bar 27 on the resilient member 6, thus making the engaging and disengaging of the locking pawl 6*a* with respect to the element rows 4 smooth. The slider of this embodiment is particularly advantageous in that the slide fastener can be attached to a product as a concealed slide fastener, in which the element rows are not exposed using the ordinary fastener stringers. Further, partly since the inner surface of the upper wing 21 to which the pull tab 5 is attached merely serves as a flat surface for frictionally guide the front surfaces of fastener tapes 3, and partly since only the portion for pivotably supporting the pivotal bar 27 protrudes on the upper surface of the upper wing 21, it is possible to reduce the width of the upper wing 21 to a necessary minimum.

Figure 4:
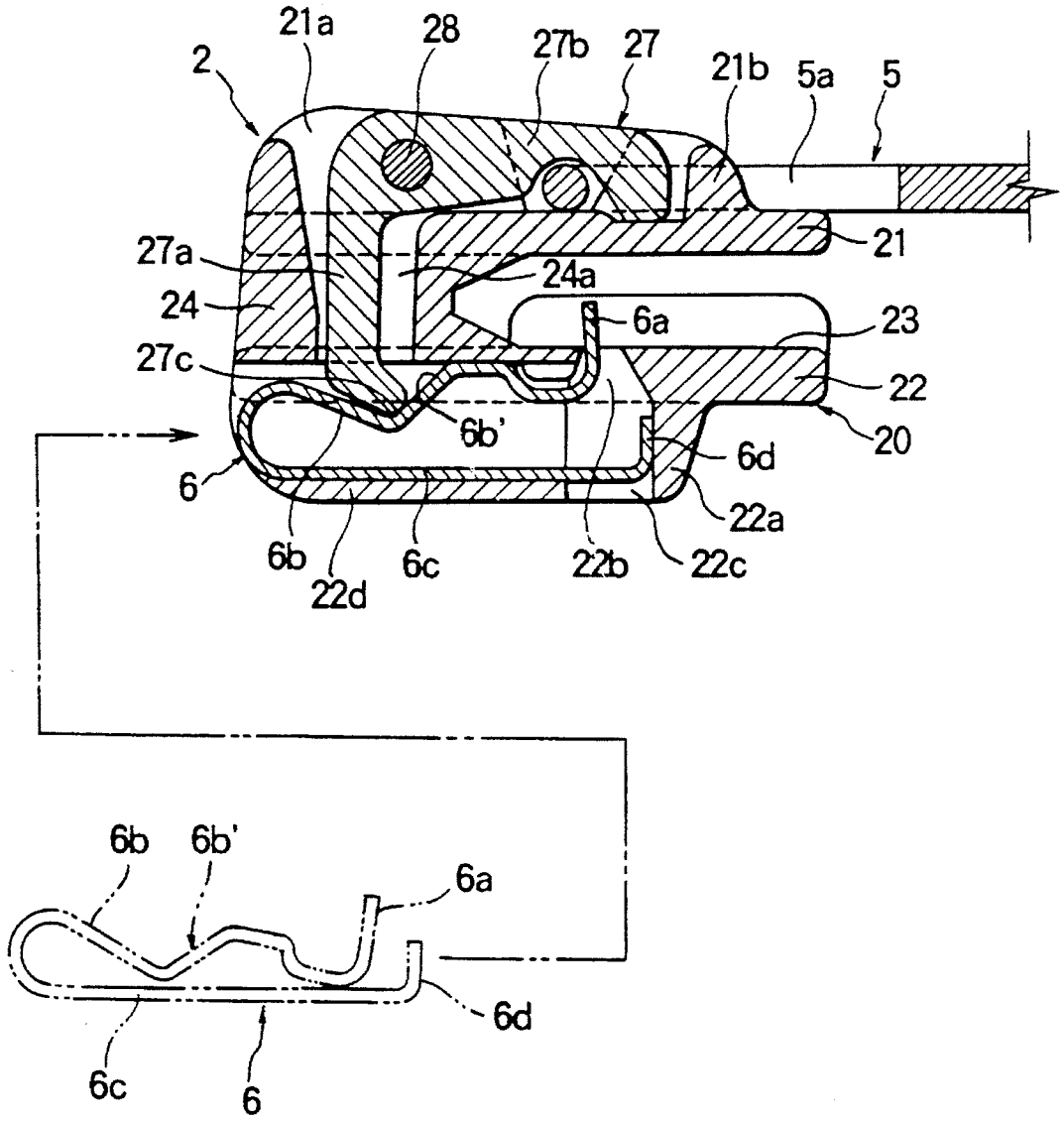
FIG. 4 is a view showing a first modification of the slider, illustrating the manner in which a resilient member is mounted on the slider.

FIG. 4 shows a modification of the foregoing embodiment of this invention. This modification is differenet from the foregoing embodiment in that the insertion portion 27*a* of the pivotal bar 27 has at its lower end a protuberance 27*c* extending toward the contact surface 6*b'* of the resilient member 6 and that the clinching projections 22*a'* of the wall 22*a* of the lower wing 22 are replaced by a bottom 22*d* to shape the lower wing 22 into a box-like form opening at an end toward the guide post 24. The protuberances 27*c* serves to assist in retracting the locking pawl 6*a* into the aperture 22*b*. Because of the box-like structure of the lower wing 22, when mounting the resilient member 6 on the slider body 20, the resilient member 6 is depressed to resiliently deform into a relatively flat form and is then inserted into the lower wing 22 from the open end. It is therefore possible to assemble the slider in a simple manner.

Figure 5:
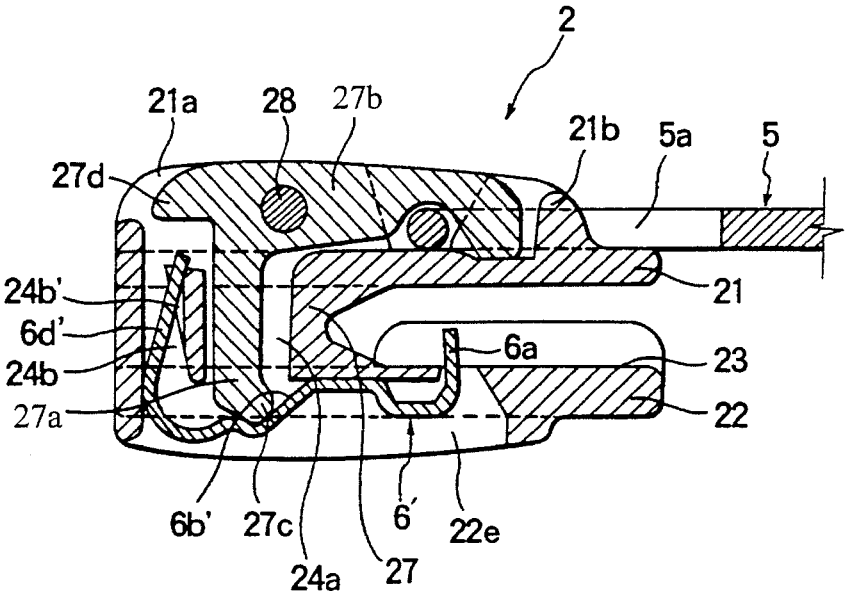
FIG. 5 is a longitudinal cross-sectional view showing a second modification of the slider.

FIG. 5 shows another modification of the embodiment. This modification is different in that the attachment portion 27*b* of the pivotal bar 27 has a projection 27*d* extending beyond the insertion portion 27*a*, that the anchor recess 22*c* of the lower wing 22 is replaced by a generally conical hole 24*b* in the guide post 24 for receiving one end of the resilient member 6' and by an anchor groove 24*b'* in the wall of the conical hole 24*b* for engagement with one end of the resilient member 6', that the lower surface of the lower wing 22 is virtually flat with only ribs 22*e* at opposite side portions for receiving the resilient member 6', and that the resilient member 6' is in the form of a small-width thin metallic leaf spring of a predetermined length bent acutely in a generally L shape having at one end an anchoring section 6*d'* to be engaged in the anchor groove 24*b'* of the guide post 24.

In the modified example of FIG. 5, its construction is very simple. Therefore, for example, when mounting the generally L-shape resilient member 6' on the slider body 20, the anchoring section 6*d'* of the acutely bent resilient member 6' is inserted into the generally conical hole 24*b* of the slider body 20 from lower side, and then the end of the anchoring section 6d' is engaged in the anchor groove 24*b'* of the hole 24*b*, and as a result, the anchoring section 6*d'* is supported at two points, i.e. its upper and lower ends, by the inner wall surface of the hole 24*b* against the resilience of the resilient member 6'. It is accordingly possible to mount the resilient member 6' on the slider body 20 simply and firmly.

Figure 8:
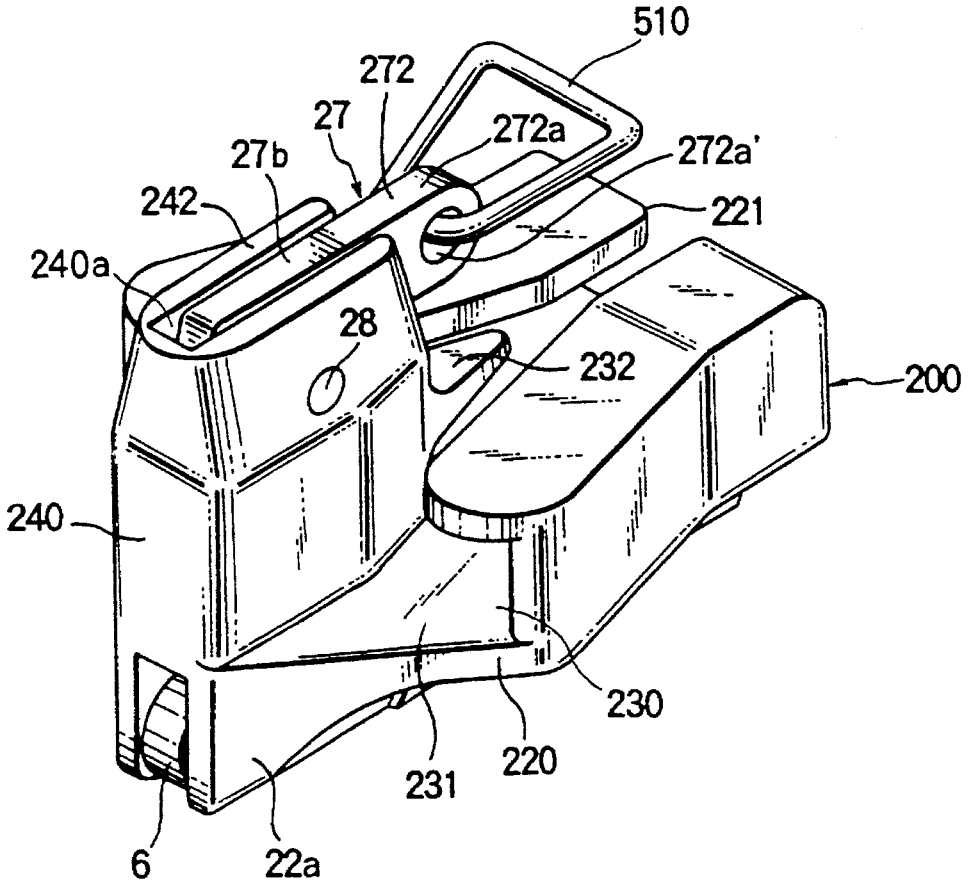
FIG. 8 is a perspective view showing a typical embodiment of an automatic lock slider, which is to be applied to the concealed slide fastener, of this invention.

FIG. 8 is a perspective view of a concealed slide fastener according to a second embodiment of this invention. In the concealed slide fastener, each of confronting inner edge portions of the opposed fastener tapes is attached is bent in a generally U shape, and each element row is attached to the corresponding fastener tape along its bent tape edge by sewing or other means.

In FIG. 8, an element guide channel 230 of a slider body 200 is defined merely by a lower wing 220 and a guide post 240 standing at one end of the element guide channel 230. Therefore, this slider, unlike the slider 2 for the ordinary slide fastener, has no upper wing. The element guide channel 230 is formed by bending opposite side margins of the lower wing upwardly to form opposite side flanges and by further bending the flanges in a generally L shape, as viewed in transverse cross section, in such a manner that their upper edges confront each other. Like the foregoing embodiment, a vertical through hole 240*a*, in which an insertion portion (not illustrated) of a pivotal bar 27 is to be inserted, extends centrally in the guide post 240. There is located at the meeting point of branches 231 of the guide channel 230 a guide rib 232 extending from the guide post 240 centrally into the guide channel 230.

This embodiment is identical with the foregoing embodiment except that since the slider body 200 has no upper wing, the attachment portion 272 of the pivotal bar 27 is received in a generally U-shape wall 242 formed on the upper surface of the guide post 240, with its end 272*a* projecting outwardly, as shown in FIG, 8. The end 272*a* of the attachment portion 272 has an attaching hole 272*a'* to which a connecting ring 510 for connecting the pull tab (not shown in FIG. 8) is pivotally attached.

The automatic lock slider, for a concealed slide fastener, of FIG. 8, like the conventional slider, is mounted on the back side of non-illustrated opposed stringers, and projecting from the front surfaces of the opposed stringers are an upper end of the guide post 240, the pivotal bar 27 and the non-illustrated pull tab attached to the pivotal bar 27 via the connecting ring 510. In this embodiment, like the foregoing embodiment, the locking pawl comes into and out of engagement with the element rows in the guide channel 230 smoothly and reliably, depending on whether or not the pull tab is pulled.

According to the automatic lock slider, for a slide fastener having element rows 4 on the back side, of this invention, partly since resilient member 6 having the locking pawl 6*a* for engagement with and disengagement from the element rows 4 from the back side is actuated by one end of the generally L-shape pivotal bar 27, and partly since the resilient member 6 is in the form of a small-width metallic leaf spring having a predetermined length and bent in a desired shape, the resilient member 6 keeps adequate resilience for a long period and secures more reliable resilient deformation and restoration compared to a mere leaf spring, so that the locking pawl 6*a* can come into and out of engagement with the element rows 4 smoothly and reliably, depending on whether or not the pull tab 5 is pulled. With the slider of this invention, not only in a concealed slide fastener but also in an ordinary slide fastener, partly since the upper wing 21 is merely flat and partly since the width of the upper wing 21 is reduced to a minimum, it is possible to reduce the part of the slider exposed on the front surface of the slide fastener to a minimum amount. With this automataic lock mechanism, since the generally L-shape pivotal bar 27 is pivotally moved about the pivot 28, the locus of movement of the lower end of the insertion portion 27*a* of the pivotal bar 27 is definitely determined to secure the reliable action of the pivotal bar 27 on the leaf spring, thus making the engaging and disengaging of the locking pawl 6*a* with respect to the element rows 4 smooth.

What is claimed is:

1. An automatic lock slider for a slide fastener, comprising:

a slider body having an element guide channel for slidably guiding opposed element rows and an element guide post situated centrally at one end of said element guide channel, said element guide post having a longitudinal through hole;

a pivotal bar having a general L shape composed of an insertion portion inserted in said through hole, an attachment portion to be normally located against an upper surface of said slider body, and a connection portion connecting said insertion portion and said attachment portion and pivotally attach to upper portion of said element guide post;

a resilient member captured in a bottom cavity of said slider body:

said pivotal bar inserted in said through hole for selectively releasing said resilient member to engage said element rows in said guide channel in a locking position or actuating said resilient member to disengage from said element rows in an unlocked position;

said resilient member being in the form of a small-width metallic leaf spring, and bent in a predetermined shape having one end constituting a locking pawl for projecting into said element guide channel through an aperture thereof when said resilient member is released from said pivotal bar; and said through hole receiving said insertion portion of said pivotal bar in such a manner that said insertion portion is pivotally movable in said through hole forwardly and backwardly of said slider body; and a pull tab rotatably attached to said pivotal bar.

2. An automatic lock slider according to claim 1, wherein said resilient member is bent in a general U shape, and the other end opposite to the locking pawl of said resilient member is fixedly attached to the bottom of said slider body, legs of said U shape resiliently collapsed by said pivotal bar to disengage said locking bawl from said element rows.

3. An automatic lock slider according to claim 1, wherein said resilient member is bent in a general L shape and has at the other end opposite to the locking pawl a rising portion fixedly attached to said element guide post.

4. An automatic lock slider according to claim 1, wherein said resilient member has a contact surface upwardly sloping toward said locking pawl, and a lower end of sa±d insertion portion of said pivotal bar is engageable with said contact surface of said resilient member when said resilient member is actuated by said pivotal bar.

5. An automatic lock slider according to claim 2, wherein said resilient member has a contact surface upwardly sloping toward said locking pawl, and a lower end of said insertion portion of said pivotal bar is engageable with said contact surface of said resilient member when said resilient member is actuated by said pivotal bar.

6. An automatic lock slider according to claim 3, wherein said resilient member has a contact surface upwardly sloping toward said locking pawl, and a lower end of said insertion portion of said pivotal bar is engageable with said contact surface of said resilient member when said resilient member is actuated by said pivotal bar.

7. An automatic lock slider according to claim 4, wherein said insertion portion of said pivotal bar has at a lower end a protuberance directed toward said locking pawl of said resilient member.

8. An automatic lock slider according to claim 5, wherein said insertion portion of said pivotal bar has at a lower end a protuberance directed toward said locking pawl of said resilient member.

9. An automatic lock slider according to claim 6, wherein said insertion portion of said pivotal bar has at a lower end a protuberance directed toward said locking pawl of said resilient member.

* * * * *